US005683750A

United States Patent [19]

Hoff et al.

[11] Patent Number: 5,683,750

[45] Date of Patent: Nov. 4, 1997

[54] HIGH SPEED COATING STARTS FOR MULTIPLE LAYER COATINGS USING A TEMPORARY TOP COAT

[75] Inventors: Joseph W. Hoff, Fairport; Douglas S. Finnicum, Webster; Steven J. Weinstein, Fairport, all of N.Y.

[73] Assignee: Eastman Kodak Company, Rochester, N.Y.

[21] Appl. No.: 688,470

[22] Filed: Jul. 30, 1996

[51] Int. Cl.[6] ..... B05D 1/30; B05D 5/00

[52] U.S. Cl. ..... 427/261; 427/258; 427/402; 427/420; 118/411; 118/324; 118/DIG. 4

[58] Field of Search ..... 427/420, 258, 427/261, 402; 118/410, 411, 324, DIG. 4

[56] References Cited

U.S. PATENT DOCUMENTS

| | | | |
|---|---|---|---|
| 3,220,887 | 11/1965 | Johnson | 117/120 |
| 3,920,862 | 11/1975 | Damschroder et al. | 427/420 |
| 3,959,528 | 5/1976 | Takeda et al. | 427/290 |
| 3,973,062 | 8/1976 | Fahrni | 427/420 |
| 4,340,621 | 7/1982 | Matsumiya et al. | 427/294 |
| 4,571,849 | 2/1986 | Gardner et al. | 34/79 |
| 4,808,444 | 2/1989 | Yamazaki et al. | 427/420 |
| 5,340,616 | 8/1994 | Amano et al. | 427/458 |

FOREIGN PATENT DOCUMENTS

| | | | |
|---|---|---|---|
| 567071 | 10/1993 | European Pat. Off. | 427/420 |

*Primary Examiner*—Katherine A. Bareford
*Attorney, Agent, or Firm*—Arthur H. Rosenstein

[57] ABSTRACT

A method of coating moveable supports at high speeds comprises moving the support along a path through a coating zone, forming two or more layers of coating liquids including an actual top coat layer to form a liquid composition (with a slide hopper coating a plurality of outlets for coating liquids) and applying a starting top most layer of coating liquid, which layer has a lower viscosity than that of the actual top coat layer, to the liquid coating composition either through the first outlet of the hopper or through an x-hopper located between the first outlet and coating zone, applying the coating composition and starting top most layer, and terminating the application of the starting top most layer when the coating operation is at steady state. Apparatus for carrying out this method is also described.

6 Claims, 1 Drawing Sheet

HIGH SPEED COATING STARTS FOR MULTIPLE LAYER COATINGS USING A TEMPORARY TOP COAT

FIELD OF THE INVENTION

The present invention concerns a method and apparatus for initiating or starting the coating of moving supports. Such method and apparatus are particularly suitable for coating products in strip form, such as for example, photographic film, paper or cloth. More particularly, the invention relates to a method and apparatus of increasing the range of support speeds over which a coating may be initiated.

BACKGROUND OF THE INVENTION

In curtain coating and bead coating operations, it is customary to apply liquid composition to a moving strip material (hereinafter referred to as a "support") by flowing the composition through a slot in a metering device (hereinafter referred to as "hopper"). These methods have been somewhat satisfactory in that uniform and useful coatings have been produced, but the speed of application is limited. To increase manufacturing productivity, factors limiting speeds at which coating operations take place need to be relaxed.

Prior art in the field (Kistler, Wettability, Vol. 49, Surfactant Science Series, Marcel Dekker, Inc.,) has established that a necessary condition for creating a uniform coating on a moving support is that the composition to be coated must displace any air that is entrained on the moving support. Failure to displace this air is termed wetting failure and will result in a non-uniform, and hence non-useful, coating. Wetting failure can be influenced by the speed of the support at which the coating operation takes place. Additionally, prior art has established that the viscosity of the coating composition is a predominant parameter that affects the speed of the support at which wetting failure will occur. Higher viscosity coating compositions will generally exhibit wetting failure at lower support speeds than a correspondingly lower viscosity coating composition.

For instance, in the bead coating process, a coating pack composed of one or more fluid layers is transferred from the hopper to a moving support. Prior to a coating event, the hopper is separated from the support by such a distance that a coating composition cannot physically contact the support. The coating composition flows over the edge of the hopper and into a vacuum trough that doubles as a sink. Once the hopper is prepared for the coating event, the distance between the hopper and the coating roll is decreased. A coating start refers to the moment when the coating composition contacts the support and a coating bead forms (the bead is defined as the region filled with fluid between the hopper and support).

The coating start is fundamental to the coating process. A good coating start can be defined as the transferal of coating fluids from a hopper to a moving support that results in an uniform coating in directions both parallel and perpendicular to the conveying direction of the support. If a coating start cannot be made at a given speed, no successful coating can be attained; even if a coating start can be made, a suboptimal start can create problems that can have lasting effects on a coating event. These problems include streak waste. As might be expected, achieving an imperfection-free coating start is a non-trivial part of the coating process.

During the coating start, the top-most layer of the coating composition is the initial layer to contact the moving support. This layer will have a viscosity greater than the bottom most layer. Inferring from cited literature, use of a high viscosity top layer will decrease the range of support speeds at which an acceptable coating start can be made. A low viscosity fluid coats better than a high viscosity fluid. Different viscosities are preferred in different parts of the coating process. A high viscosity top layer is preferred on the hopper slide and support during steady-state coating, but low viscosity is preferred at the coating bead during the start.

In order to achieve a good coating start, three criteria must be satisfied. The first necessary condition for a coating start is that there be enough coating fluid to bridge the gap between the hopper and support. Generally this is not a problem. However, elevated levels of vacuum may thin a coating composition to the extent where it can no longer touch the support. Similarly, an improperly set spacing between the hopper and support may also create such a problem. Severe cases of mechanical distortion of the hopper, or a misaligned hopper can result in a non-uniform fluid contact with a support. A non-uniformly applied vacuum or an improperly prepared hopper can lead to non-uniform fluid contact with the support as well.

The second necessary condition is that the support and coating composition must be compatible. If they are not, wetting failure, as characterized by the irregular entrainment of air between the liquid and support, will occur at a coating start. In extreme cases, a coating fluid will overflow the edging hardware instead of dynamically wetting the support. In the case where one is successfully coating yet progressively raises the coating speed, wetting failure will ultimately arise.

Thus, a third necessary condition is that the speed of the support, as it moves through the coating zone, must be below the wetting failure speed. Wetting failure speed is a practical limit of speed on a coating start. The problem of attaining acceptable coating starts has been addressed for instance in U.S. Pat. No. 3,220,877 where air pressure differential is used and in U.S. Pat. No. 3,959,528 where roughening the surface of a portion of the support surface avoids a thick coating at the start. In U.S. Pat. No. 4,340,621 it is taught that a pressure reduction of a bead stability suction chamber is set at a value higher than that used for steady-state operation. U.S. Pat. No. 4,808,444 discloses a backing roller which is rapidly moved by a pneumatic mechanism relative to the hopper between positions at which the composition can and cannot be applied to the traveling web in order to avoid thick coating at a leading portion or at a spliced portion of the web. U.S. Pat. No. 5,340,616 teaches the use of an electric field whose level is greater than the steady state coating electric field level.

The present patent application provides a novel technique for increasing the attainable speeds tier a coating start while not interfering with the normal, steady-state coating operation.

SUMMARY OF THE INVENTION

An object of this invention is to provide a coating method in which, in addition to maintaining steady-state coating operations, the problems associated with start-up coatings are corrected.

This object and others in coating moving strips at high speed are met by using a method for applying multiple layers of coating liquids to a moving support comprising moving a support along a path through a coating zone; forming one or more layers of coating liquids, said coating layers including an actual top coat layer, to form a liquid coating composition with a slide hopper containing a plurality of outlets for coating liquids; applying an additional starting top most layer of coating liquid (over the actual top coat layer) to the liquid coating composition either through the first outlet of the hopper or through a metering device located between the first outlet and the coating zone; said starting top coat having a lower viscosity than the actual top coat layer; applying the coating composition and starting top most layer as the start coating, said starting top coat layer having a composition to assure weltability (base compatibility) at the desired wetting speed; and terminating the application of the starting top most layer when the coating operation is at steady state.

Apparatus for accomplishing the above method comprises means for moving a support along a path through a coating zone; a slide hopper for forming one or more layers of coating liquids along a slide, the slide layer terminating at a lip; means for distributing a starting top layer of coating liquid on the one or more layers of coating liquids; said means being located between the first outlet on the slide hopper and coating zone; and wherein one or more layers are deposited on the moving support at the coating zone.

The nature, principle and utility of the invention will become more apparent from the following detailed description when read in conjunction with the accompanying drawings.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

Figure 1:
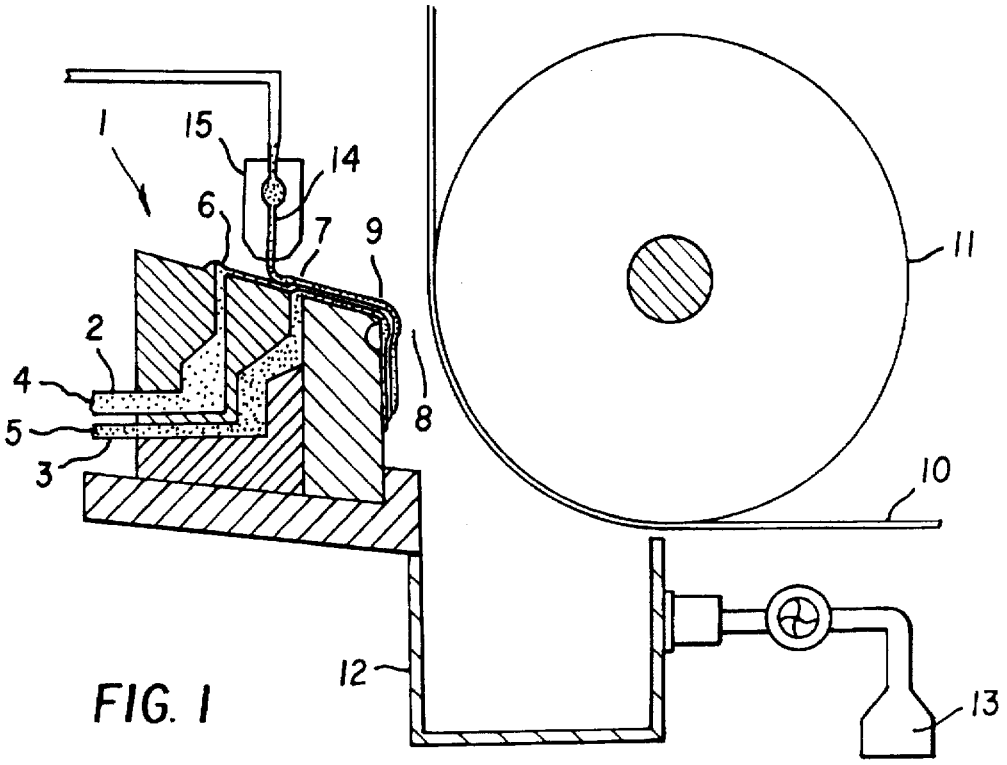
FIG. 1 is a drawing of the apparatus used for the start of a coating system.
Figure 2:
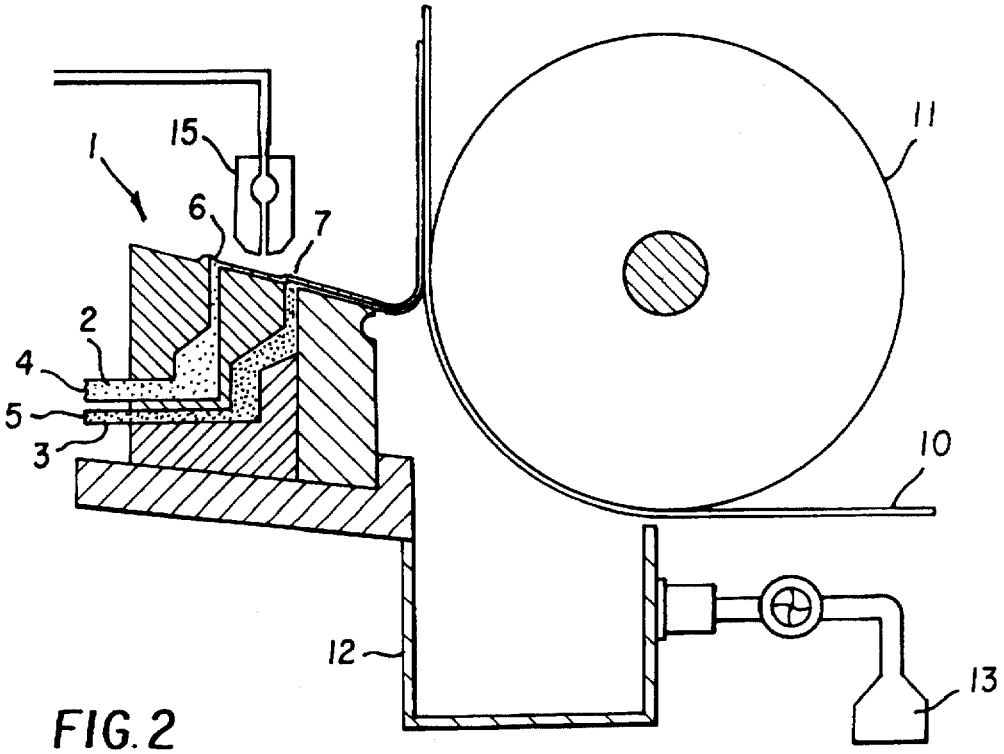
FIG. 2 is a drawing of the coating system of the present invention at steady state.

A preferred embodiment of the present invention is described below in detail with reference to FIG. 1, which is a side view showing the embodiment schematically. FIG. 1 shows conventional apparatus and an additional metering device for metering a multilayer coating on a film support comprising a hopper 1 comprising two components 2,3 (assuming the support is to be coated with two layers) each component containing an inlet 4,5 and an outlet (or exit slot) 6,7 where the inlets allow each coating composition for each layer to be delivered to its compartment in the hopper and the outlets allow for the coatings to be delivered to the coating zone 8. Thus, the first layer of the coating will be applied from the compartment closest to the lip 9. The coating hopper itself can be formed from materials such as stainless steel, titanium, and the like. Under steady state coating conditions, as depicted in FIG. 2, note that the starting top coat layer 14 (indicated in FIG. 1) is no longer being applied. Additionally, as shown in FIGS. 1 and 2, note that the lip 9 is the location where all the coating layers contact the support 10 which is carried by a coating roll 11. A vacuum 12 can be supported by vacuum source 13 as in U.S. Pat. No. 3,220,877.

The support or web that can be used in the present invention may be selected from a broad range of materials including paper, plastic films, metals, resin coated paper and synthetic paper. Plastic films may be made of the various materials including polyolefins such as polyethylene and polystyrene, vinyl polymers including polyvinyl acetate, polyvinyl chloride and polystyrene, polyamides such as nylon 6,6 and nylon 6, polyesters such as polyethylene terephthalate and polyethylene-2,6-naphthalate, polycarbonates, and cellulose acetates such as cellulose triacetate and cellulose diacetate. Resins for use in resin coated paper are typified by, but not limited to, polyolefins such as polyethylene. The morphology of the surface of resin coated paper is in no way limited, and it may or may not be embossed. Metallic webs may be exemplified by an aluminum web.

The foregoing description of the present invention is directed to coating using a slide hopper, but the invention may of course also be applied to an extrusion-type hopper (X-hopper), etc.

As shown in FIG. 1, coating compositions are supplied to compartments 2,3 and the actual top coating is supplied to the inlet 4 of compartment 2 and exits through the exit slot 6 so that it becomes the actual top layer applied to the support. This conventional hopper apparatus is useful in the method of the present invention for reducing defects caused by the start of the coating operation. In conventional coating operations, the same top layer is applied throughout the coating operation. In the present invention, a starting top layer 14 is supplied through a means for forming a starting top layer such as an additional metering device 15, such as a separate coating hopper, is also located between the first outlet (containing the actual top coat material) on the slide hopper and the coating zone 8 to the top coat compartment at the start of the coating operation and is continuously applied only until a steady state is reached. Both the actual top layer from the hopper and the additional starter top layer as provided through the X-hopper are on the coating start. When the coating reaches steady state, the X-hopper layer is turned off. In an alternative embodiment, the actual top coat can be inserted into inlet 5 and out of exit slot 7 and the starting top coat can be applied through inlet slot 4 of the actual hopper and out of exit slot 6 until steady state coating is reached. In this way an X-hopper is not necessary. Of course, if more layers are needed in the composition pack they would go into inlet slot compartments positioned closer to the coating zone and out of exit slots for those compartments (as shown in FIG. 1 ). Steady state coating occurs when the layer thickness coated on the support remains constant with time and is readily determinable.

In this apparatus, the actual coating layers including the actual top coat are applied from the exit slot 6 and the starting top coat applied from the X-hopper 15. Between the outlet containing the actual top coat on the first slide hopper and the coating zone 8 (where the coating pack is applied to the support), the starting top coat described above is applied by the means for forming a starting top layer by X-hopper 15 which is an additional metering device. This means can generally be a separate slide layer which contains the starting top coat material. The starting top coat is applied to the rest of the coating pack at the start of the coating operation, and is terminated when the coating operation reaches steady state (as indicated in FIG. 2).

The useful composition of the starting top coat is determined by the ability of the material to wet the target support at a useful speed. The starting top coat has a viscosity lower than that of the actual top coat in the region where the coating composition transitions from slide to support. Preferably, the starting top coat has a surface tension lower than the layer directly under the starting top coat (actual top coat layer) and more preferably, the surface tension of each of the coating layers is decreased from the bottom most layer to the starting top coat.

The starting top coat aids in wetting the support as the coating pack makes contact and is not needed after steady state coating is achieved.

The starting top layer composition is altered to lower its viscosity. Examples of ways to adjust the viscosity of starting top layers include adding or removing ingredients such as shear thinning polymers, as described in copending U.S. patent application Ser. No. 08/688,487, filed on Jul. 30, 1996 by the same inventors.

In this invention, separate top coatings are used for starting and steady state. The starting top coat can be separately applied by X-hopper or can be pumped into the main hopper to be applied to the actual top coat until steady state is achieved and then discontinued.

Typical layers that may be applied as part of the coatings of the webs including the actual top coat am light sensitive emulsions, dispersions and antihalation layers.

While the invention has been described with particular reference to a preferred embodiment, it will be understood by those skilled in the art the various changes can be made and equivalents may be substituted the elements of the preferred embodiment without departing from the scope of the invention. In addition, many modifications may be made to adapt a particular situation in material to a teaching of the invention without departing from the essential teachings of the present invention.

We claim:

1. A method for applying multiple layers of coating liquids to a moving support comprising:

moving a support along a path through a coating zone;

forming one or more layers of coating liquids to form a liquid coating composition by exiting coating liquid from one or more outlets of a slide hopper;

applying said one or more layers of coating liquids, including an actual top coat layer, which layer is applied through starting and steady state coating operations and is the layer beneath a staring topmost layer before contacting the web and becomes the actual topmost layer at steady state;

applying a starting topmost layer of coating liquid to the liquid coating composition, said starting topmost layer having a lower viscosity in a transition region between slide and support than said actual top coat layer, said starting topmost layer being applied either through a first outlet located farthest from the lip of the hopper or through a metering device located between the first outlet and coating zone where the coating impinges the support after it leaves the hopper;

applying the coating composition and starting topmost layer as a staring coating; and terminating the application of the starting topmost layer but continuing the application of the remaining layers when the coating operation is at steady state where the layer thickness coated on the support remains constant with time.

2. The method of claim 1 wherein the starting topmost layer has a surface tension less than a surface tension of the layer directly under the starting topmost layer.

3. The method of claim 2 wherein the layers have a surface tension decreased from the bottom-most layer to the starting topmost layer.

4. The method according to claim 1 wherein applying the liquid coating composition to the moving support is by bead coating.

5. The method according to claim 1 wherein applying the liquid coating composition to the moving support is by curtain coating.

6. The method according to claim 1 wherein the starting topmost layer comprises a shear thinning polymer.

* * * * *